United States Patent [19]

Watson

[11] 4,300,855

[45] Nov. 17, 1981

[54] ROTATABLE ICE-FORMATION-PREVENTING DEVICE

[76] Inventor: Kenneth Watson, 227 Scott Dr., Annapolis, Md. 21401

[21] Appl. No.: 130,009

[22] Filed: Mar. 13, 1980

[51] Int. Cl.[3] ..... E02B 15/02

[52] U.S. Cl. ..... 405/61; 405/22; 405/211

[58] Field of Search ..... 405/211–217, 405/60, 61, 22, 23, 195

[56] References Cited

U.S. PATENT DOCUMENTS

| | | | |
|---|---|---|---|
| 3,068,655 | 12/1962 | Murray et al. | 405/22 |
| 3,148,509 | 9/1964 | Laurie | 405/61 X |
| 3,193,260 | 7/1965 | Lamb | 405/61 X |
| 3,686,887 | 8/1972 | Bruce | 405/211 X |

FOREIGN PATENT DOCUMENTS

| | | | |
|---|---|---|---|
| 309121 | 6/1933 | Italy | 405/62 |

*Primary Examiner*—Dennis L. Taylor
*Attorney, Agent, or Firm*—Watson, Cole, Grindle & Watson

[57] ABSTRACT

A generally cylindrical member which can be used to circulate subsurface water upwardly to mix with the surface water, the surface water being colder than the subsurface water due to its being exposed to the cold air thereabove, the member including an elongated hollow lower portion and an enlarged, partially hollowed out head portion, the enlarged head portion including equally axially spaced apart radial channels extending between the hollowed out interior and the periphery thereof. When the device is submerged sufficiently that the channel outlets will be just below the water's surface, and then the device is rotated by a vertically extending shaft, water will be centrifugally ejected through the channels from the interior of the enlarged head portion to mix with the cold water at the water's surface. At the same time, warmer subsurface water will be sucked into and through the hollow lower portion, thereby creating a flow of warmer subsurface water through the device and to the surface. In one embodiment of the device additional elongated hollow cylindrical members can be telescopically interconnected in a slidable fashion to the elongated hollow lower portion of the generally cylindrical member, the enlarged head portion of the generally cylindrical member can be made buoyant, and the entire device can be constructed so as to be slidable around a vertically extending shaft used to rotate the device, such that the device can accommodate changes in the surface level of the water which occur, for example, in tidewater areas.

21 Claims, 15 Drawing Figures

FIG. 6
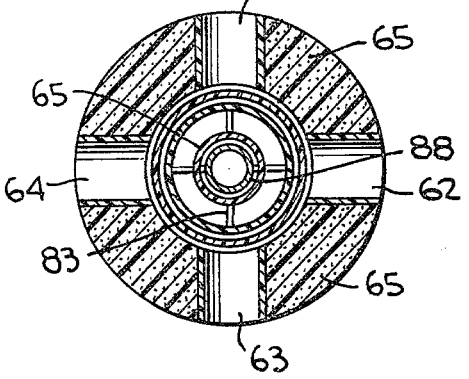
FIG. 7
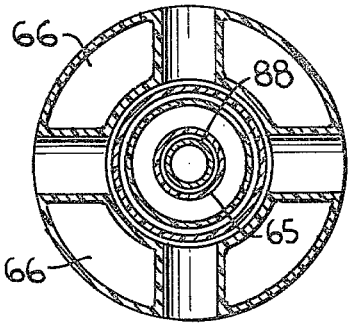
FIG. 8
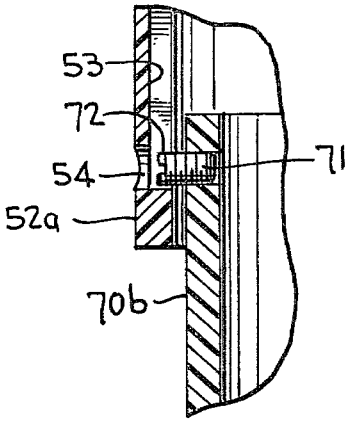
FIG. 9
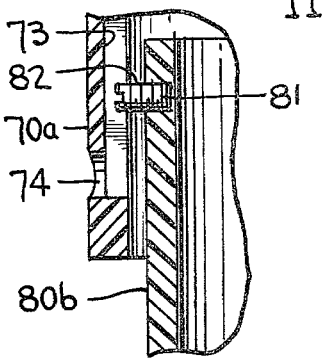
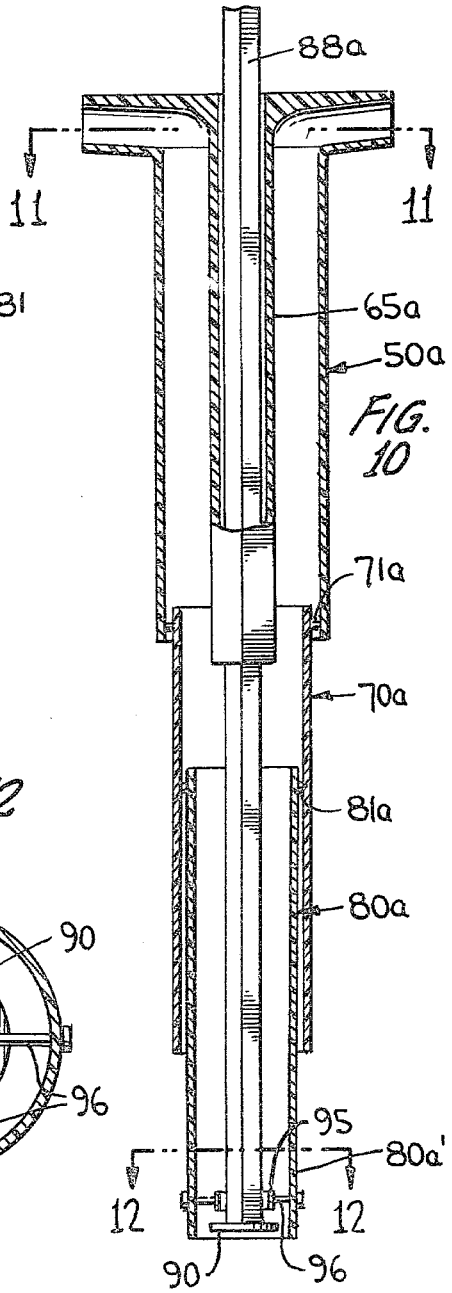
FIG. 10
FIG. 11
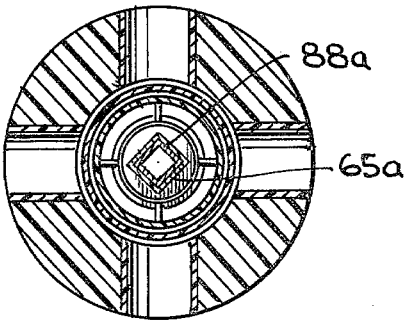
FIG. 12
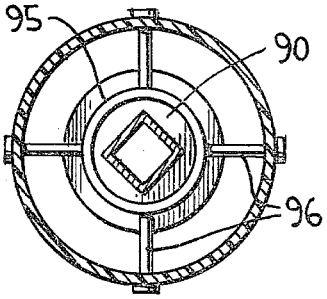

ROTATABLE ICE-FORMATION-PREVENTING DEVICE

FIELD OF THE INVENTION

The present invention relates to devices which can be used to prevent the formation of ice on the surface of a body of water which is exposed to cold air thereabove.

BACKGROUND OF THE INVENTION

Many different types of devices have been constructed which can act to prevent the formation of ice on the surface of a body of water and thus prevent ice damage to platform pilings, docks or pier pilings, boat hulls, etc., during cold times of the year. However, some of the known devices are quite complicated and expensive to manufacture, some are not useful in various applications, and some are simply not very effective.

Various types of ice-formation-preventing devices which function by mechanically breaking the ice as it begins to form are known. Such devices are shown, for example, in Schirtzinger, U.S. Pat. No. Re. 28,332; in Stone, U.S. Pat. No. 3,807,179; and in Lichtenberger, U.S. Pat. No. 4,077,225. However, these devices are both complex in construction, expensive, and not at all practical for non-commercial use.

Other types of ice-formation-preventing devices are known which function by heating the surface of the water in contact with the cold air thereabove. One such device which is shown in Bogosh, U.S. Pat. No. 4,127,992, involves the use of a hollow piling containing an anti-freeze solution. The lower end of the hollow piling is pounded down to extend to a significant degree into the bed at the bottom of the body of water around the dock, and the upper portion of the hollow piling is heated due to the anti-freeze solution circulating in the piling. This circulation acts to transfer latent ground heat to the upper portion of the hollow piling. Thus, since the piling itself will be heated to some extent, the water around the piling will be theoretically heated sufficiently to maintain a fluid interface between the piling and the ice forming therearound. However, this system requires the use of special hollow pilings which become an integral part of the dock which it supports, and thus is not portable or practical for use in preventing ice formation around existing docks. A device which uses the same anti-freeze circulation principles as Bogosh, but which is quite differently constructed, is shown in Baer, U.S. Pat. No. 3,618,569.

In Gross, U.S. Pat. No. 3,109,288, an ice-formation-preventing device is shown which comprises an electric motor which is mounted on the bed at the bottom of a body of water, this motor operating to suck air through an air line (which is connected at one end to the motor and at its opposite end to a float which keeps it exposed to the air above the surface of the body of water), and thereafter injecting the air in a column of water created by rotation of a propeller which is mounted on the motor. Operation of the motor causes the propeller to generate a column of water moving below and (preferably) parallel to the surface of the water, as well as air to be sucked downwardly through the air line so as to form bubbles in the column of water. Since the bubbles in the water column will cause the column to have a reduced density, the column will slowly rise to the water's surface, thereby causing the deeper, warmer water to rise to the surface and prevent ice formation.

However, it is not practical to continuously maintain an electric motor below the surface of a body of water since, for one thing, over a period of time leaking seals will ultimately cause a malfunction of the motor and possibly serious damage to its internal parts.

In Clarke, U.S. Pat. No. 3,170,299, ice formation around a piling is prevented by placing a tubular device therearound, the device including a sleeve formed of a material having a high thermal conductivity such as copper or aluminum and a buoyant ring bonded to the outer upper portion of the sleeve. Due to the laws of heat conductivity, heat from the water of the lower strata of the body of water around the piling will be conducted upwardly through the sleeve so as to heat the water between the sleeve and the piling theoretically sufficiently to keep it from freezing. The buoyant ring keeps the tubular device in an appropriate position around the piling based on the surface level of the water therearound. However, since the sleeve must be made of a high thermal conductivity metal such as copper or aluminum, such materials will eventually corrode as a result of their exposure to the water therearound and over a period of time will become seriously damaged. Thus the device's durability is not terribly good.

In Lamb, U.S. Pat. No. 3,193,260 a complicated ice-formation-preventing device is shown which requires the pumping of air to a manifold below a casing member having a curved lower wall, the upwardly moving air bubbles discharged from the manifold moving over the curved lower wall of the casing member so as to create an upward movement of warm sub-surface water to the water's surface. However this device is quite complicated to construct and somewhat cumbersome to use. A somewhat similar device is shown in Cramer, U.S. Pat. No. 3,667,873; however, this device suffers some of the same disadvantages as noted with respect to the Gross patent.

In Sare, U.S. Pat. No. 3,373,821, an ice-formation-preventing device is shown which includes a submerged propeller rotated by a shaft connected to a wind-operated motor mounted on posts imbedded in the bed of a pond. The propeller creates an upflow of lower, warmer water to the surface so as to prevent ice formation. However, this device does not adapt itself to variations in the surface level of the water in the pond and is not easily portable from one location to another.

Finally, in Bruce, U.S. Pat. No. 3,686,887, a tubular device is shown which is positioned around the bottom of a piling and which is rotated so as to suck water from above the adjacent bed of the body of water and circulate it upwardly around the piling and then tangentially away from a higher up portion of the piling. This device, however, instead of being intended to pump warm water upwardly to the water's surface so as to prevent ice formation, is intended only to prevent particulate erosion from around the bottom of the piling. Thus it must always be hollow and positioned around a stationary and non-rotating piling member.

It is an object of the present invenion to provide an ice-formation-preventing device which is simple in construction, easy to service, portable, and which can be made of inexpensive and non-corrosive materials.

It is also an object of the present invention to provide an ice-formation-preventing device which can be attached to a rotatable shaft stationary attached to a platform such as a dock or pier and which can accommodate variations in the surface level of the water without need for continuous repositioning of the shaft.

SUMMARY OF THE PRESENT INVENTION

According to the present invention the ice-formation-preventing device comprises, in its simplest form, a cylindrical member having an elongated lower portion and an enlarged head portion, the elongated lower portion being hollowed out such that the lower portion has a tubular configuration, and the enlarged head portion also being partially hollowed out to form an interior flow space. The enlarged head portion includes a cap member on the top side thereof which encloses the hollowed out area therewithin, and the outer periphery of the enlarged head includes at least two radially-extending flow channels which allow water to flow from the internal flow space outwardly from the enlarged head portion. When the device is positioned sufficiently below the surface of a body of water exposed to cold air such that the exit outlets of the channels are submerged to a point just below the surface, and the device is then rotated by a shaft connected to the cap member of the head portion, centrigugal force will cause water to flow outwardly through the channels and at the same time water will flow upwardly from the bottom of the elongated hollow lower portion. In this way, warmer subsurface water will be caused to circulate upwardly to the surface so as to heat the surface water and prevent ice formation.

In another embodiment of the present invention the device may include an upper member, a slidably interconnected intermediate member and a slidably interconnected lower member. The upper member resembles the cylindrical member of the above-discussed simpler embodiment of ice-formation-preventing device; however, the cap member is annularly shaped, and connected to the inner rim of the cap member is an elongated interior member having a tubular shape which extends centrally through the interior of both the upper head portion of the upper member and the elongated lower portion. In addition, elongated grooves are provided on the elongated lower portion. The intermediate member comprises a hollow cylindrical member which is axially slidable along the elongated lower portion of the upper member, and the intermediate member includes button members attached to the upper end which are slidably engageable within the noted grooves in the elongated lower member. The intermediate member also includes elongated grooves similar to the elongated grooves in the elongated lower portion. Finally, the lower member comprises a hollow cylindrical member which is axially slidable along the intermediate member, and it also includes button members attached to the upper end which are slidably engageable within the grooves in the intermediate member. The lower end of the lower member includes means for fixedly attaching it to the lower end of stationary rotatable shaft that extends downwardly through the interior member in the upper member, through the center of the intermediate member and through the center of the lower member, such that rotation of the shaft will cause not only rotation of the lower member, but as a result of interengagement between the respective button members and grooves, both the intermediate member and the upper member as well. Water will consequently be caused to flow upwardly through the device from the open lower end of the lower member and then outwardly via the channels in the enlarged head portion of the upper member.

The enlarged head portion of the upper member will also include a buoyancy-creating means such that the upper member will float adjacent the surface level of the water regardless of any changes relative to the lower end of the rotatable shaft, i.e., via sliding of the head portion along the length of the rotatable shaft and concurrent sliding (telescopic) adjustments in the relative positionings of the upper, intermediate and lower members.

In a variation of inventive embodiment just described, the noted elongated interior member attached to inner rim of the cap member of the buoyant upper member will have a generally square cross section, such that when the shaft extending therethrough has a corresponding (yet slightly smaller) cross section, the rotation of the shaft will directly cause rotation of the upper member. In this embodiment the lower end of the lower member can include a means which is cooperable with abutment means connected to the lower end of the rotatable shaft for preventing the lower member (and thus the entire ice-formation-preventing device) from falling away from the stationary shaft when the water level falls to a significant degree.

In an additional embodiment of the invention the ice-formation-preventing device may more simply consist of only the noted buoyant upper member having an elongated interior member therein with a square cross section, such that rotation of the shaft (which has a corresponding yet smaller square cross section) will directly cause rotation of the buoyant upper member. The upper member will be slidable along the length of the shaft, and can include a means at the lower end of the elongated lower portion thereof which is cooperable with abutment means connected to the lower end of the rotatable shaft to prevent the upper member from falling away from the stationary shaft when the water level falls to a significant degree.

Further objects, features and advantages of the present invention will be seen from a review of the accompanying drawings taken in conjunction with the following description.

DESCRIPTON OF THE DRAWINGS

In the drawings,

FIG. 6 shows a view of the device of FIG. 5 as seen along line 6—6;

FIG. 7 shows a view similar to that shown in FIG. 6 but wherein the ice-formation-preventing device of FIG. 5 is constructed according to another embodiment of the present invention;

FIG. 8 shows an elongated view of the structure found within the area A as shown in FIG. 5;

FIG. 9 shows an enlarged view of the structure found within the area B shown in FIG. 5;

FIG. 10 shows a cross sectional view of a further embodiment of ice-formation-preventing device constructed in accordance with the present invention, the lower portion of a drive shaft used to rotate the device also being shown;

FIG. 11 shows a view of the device of FIG. 10 as seen along line 11—11;

FIG. 12 shows a view of the device of FIG. 10 as seen along line 12—12;

DETAILED DESCRIPTION OF SOME PREFERRED EMBODIMENTS

Figure 1:
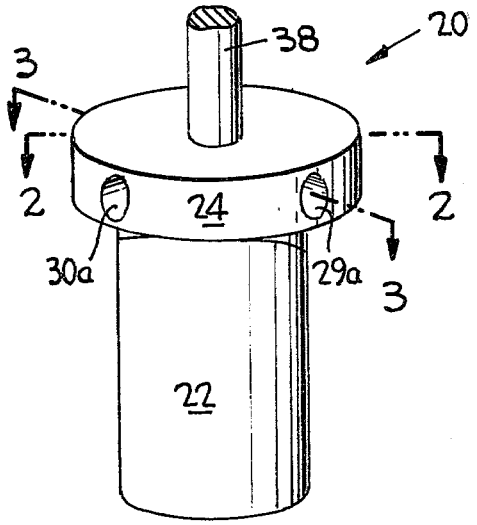
FIG. 1 shows a perspective view of one embodiment of ice-formation-preventing device constructed in accordance with the present invention, the lower end of a drive shaft used to rotate the device also being shown.
Figure 2:
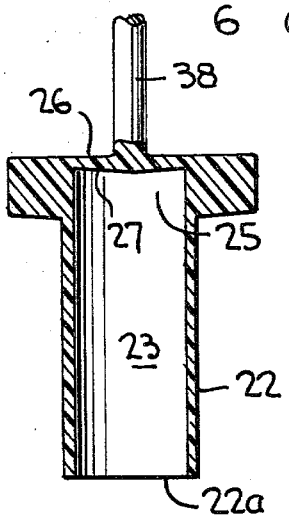
FIG. 2 shows a cross sectional view of the device in FIG. 1 taken along line 2—2.
Figure 3:
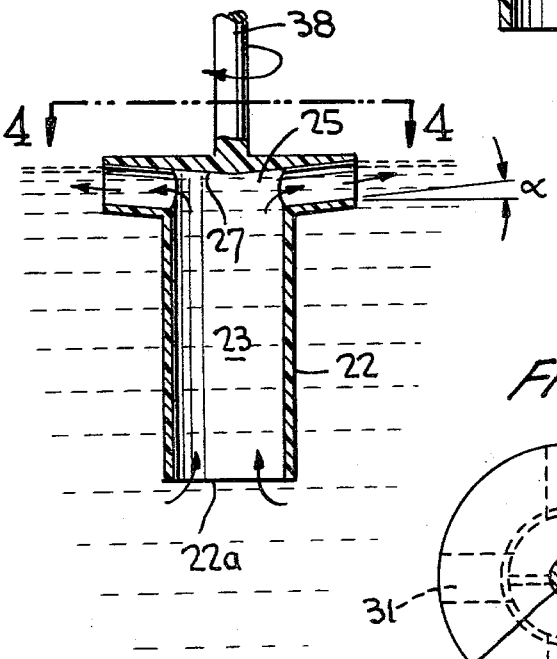
FIG. 3 shows a cross sectional view of the device in FIG. 1 taken along line 3—3.

The simplest embodiment of rotatable ice formation-preventing device constructed in accordance with the present invention is shown in FIGS. 1–4, FIG. 1 showing a perspective view of the overall device. This device, generally labeled as 20, comprises a generally cylindrical member having an elongated lower portion 22 and an enlarged head portion 24, the enlarged head portion 24 including fluid channels radially extending therethrough so as to have externally visible outlet ends (for example, see numerals 29*a* and 30*a* in FIG. 1). Fixedly connected to the center of the head portion 24 of the device by screws (not shown) is a rotatable shaft 38 which functions both to suitably position the device below the surface of the water in which it is to operate, as well as to rotate the device so that it will operate as intended. Although only the lowermost portion of the rotatable shaft 38 is shown in FIGS. 1, 2 or 3, when connected to operate the device 20 it will extend upwardly from the center of the head portion 24 to connect with a suitable driving mechanism fixedly attached to either a stationary platform, such as a dock or pier, or to a floating platform, such as a boat or buoy. The shaft will normally be made of a durable metal such as aluminum. The driving mechanism may itself comprise any type of apparatus which can rotate shaft 28, but preferred systems include suitably connected motors (see FIG. 13) and/or windmills (see FIG. 15).

The ice-formation-preventing device 20 may be fabricated from any suitable durable and non-corrosive material, although strong plastic materials, such as polyethylene or polypropylene, are preferred because they are not only non-corrosive in fresh or salt water applications and inexpensive, but they are also easily adaptable to molding techniques.

As best seen in FIGS. 2 and 3, which Figures show two different cross sectional views of the device 20, the combined elongated lower portion 22 and enlarged head portion 24 provide an ice-formation-preventing device which displays a generally T-shaped appearance.

The inside of the elongated lower portion 22 is hollowed out so as to result in the elongated lower portion having a tubular configuration with an internal flow passageway 23, and the inside of the enlarged head portion 24 is also partially hollowed out to provide an interior flow area 25. As best seen in FIG. 2, the interior wall of the head portion 24 which forms the periphery of the interior flow area 25 is coaxial with the interior wall of the lower portion 22 and of an equal diameter therewith, such that the entire internal flow area 25 directly communicates with the internal flow passageway 23. The enlarged head portion 24 also includes a generally disk-shaped cap member 25 on the top side thereof, this cap member 25 including a generally conically-shaped portion 27 on the underside thereof which faces the interior flow area 25. The maximum diameter of the generally conically-shaped portion 27 is essentially equal to the diameter of the interior wall of the enlarged head portion 24 as indicated in FIG. 2.

Figure 4:
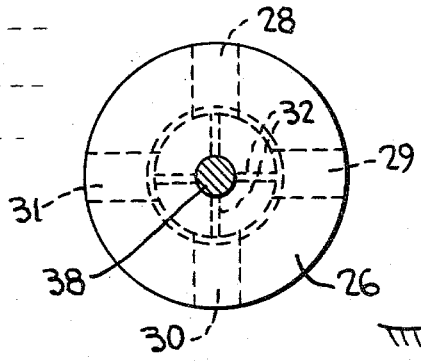
FIG. 4 shows a view of the device in FIG. 3 as seen along line 4—4.

As can be seen in FIGS. 1, 3 and 4, the enlarged head portion 24 also includes four equally angularly spaced apart, radially-extending channels 28, 29, 30 and 31 in the outer peripheral portion thereof. These channels allow for fluid communication between the interior flow area 25 within the enlarged head portion 24 and the exterior of the enlarged head portion. It should be noted that although four channels have been shown in the device 20, as few as two (opposed) channels could be utilized, the exact number being determined in any given case by the overall size of the ice-formation-preventing device and the total volume of water to be passed therethrough. To achieve a balancing of the device, the channels should always be equally angularly spaced from one another.

The channels 28–31 are shown in FIGS. 1, 3 and 4 to be circular in cross section and uniform in diameter, and this is the most preferred configuration. However, they could be of some other cross-sectional shape such as square, oval or rectangular, and they could be of non-uniform dimensions, i.e., they could increase or diminish in cross sectional dimensions along their radial length. The channels 23–31 are also shown in FIG. 3 to extend upwardly towards an imaginary plane formed by the cap member 26 at an angle $\alpha$, this angle preferably being between about 2° to 5°, so that water passed therethrough will be discharged at a slightly upward angle, this being the preferred orientation. However, the device could still be operable in some situations if the channels were to extend in parallel with an imaginary plane formed by the cap member 26. Finally, although the channels 28–31 have been shown as extending linearly along their entire length, they could also have curved segments adjacent to their outlet ends (not shown), provided, however, that their initial segments adjacent the interior flow area 25 extend radially with respect to the interior flow area 25 and provided that all the curved segments for each respective channel are identical in shape and orientation.

In operation, and assuming that the device 20 has been suitably submerged in a body of water by positioning of the attached vertically-extending shaft 38 such that the water level is at least above the uppermost portion of the outlet ends of each of the channels 28–31 (this being necessary to avoid any air pockets forming in any of the channels and impeding water flow therethrough), the shaft 38 is rotated in one direction or another (in FIGS. 2 and 3 the rotation is shown to be clockwise), and the rotation of shaft 38 will concurrently cause the device 20 to rotate. This rotation, even if it is quite slow, will force water located in the interior flow area 25 within the enlarged upper head portion 24 to flow through channels 28–31 and out their outlet ends due to centrifugal forces acting thereon. This water flow will then cause water to be sucked into the lower end 22*a* of the elongated lower portion 22 and through internal flow passageway 23 to create a continuing water flow pattern as indicated by the arrows in FIG. 3. Thus water which is below the surface, and which is warmer during times of cold weather as a result of its being insulated to some extent from the cold air contacting the water's surface, will be sucked up and discharged from the channel outlets in the enlarged head portion to mix with the water at or near the water's surface and thereby increase the temperature of the water at the surface sufficiently to prevent ice formation.

The length of the elongated lower portion 22 will be determined by the depth from the surface of the water to which the lower end 22*a* must extend in order to reach water which will have a sufficiently high temperature that its discharge at or near the water's surface will prevent ice formation at the surface. The length cannot, however, be so long that the lower end will suck up sand, debris or any large-sized living organisms from the bottom of the water system. A suitable length may be two to three feet. To help prevent large objects such as fish from entering the device and perhaps clogging up one or more of the channels 28–31 or otherwise making the device inoperative, the lower end 22*a* of the elongated lower portion 22 can include one or more protective bars 32 extending across the interior which act as a type of screen.

A somewhat more complex, yet more widely useful, embodiment of the present ice-formation-preventing device is shown in cross section in FIGS. 5–9. This embodiment represents a device which is useful in situations where rotatable driving shaft will be stationarily mounted, but where the level of the water in which the device is positioned will vary, such as in tidewater areas or even lakes where significant water level changes can sometimes occur. Although this embodiment is similar in many respects to that shown in FIGS. 1–4, a number of significant differences are readily apparent.

The device, generally labeled as 40 in FIG. 5, comprises an upper member 50, an intermediate member 70 and a lower member 80, and fixedly connected to the device is a rotatable shaft 88 which functions both to suitably position the device (and more particularly the lower member 80) below the surface of the water in which the device is to operate, as well as to rotate the device so that it will operate as intended. The upper end of the rotatable shaft 88 is preferably fixedly attached to a stationary platform such as a dock or pier (see FIGS. 13 and 15).

The upper member 50 comprises a generally cylindrical member having an elongated lower portion 52 and an enlarged head portion 56, the elongated lower portion 52 being hollowed out so as to have a tubular configuration with an internal flow passageway 59 and the enlarged head portion 56 also being partially hollowed out to provide an interior flow area 57. Positioned to extend centrally through the interior of both the upper head portion 56 and the elongated lower portion 52 is an elongated tubular interior member 65, the upper end of which is connected to the inner rim of a cap member 58 which is in the general form of an annular disk. As indicated in FIG. 5, the annular cap member 58 will have a generally triangular cross section so as to provide, together with the annular cup-shaped surface 60, uniform diameter flow channels, 61, 62, 63 and 64 which will have a slightly upward angular orientation similar to the channels 28–31 in the FIGS. 1–4 embodiment.

The inner diameter of the elongated tubular interior member 65 is such as to enclose rotatable shaft 88 which extends therethrough with only a slight leeway, yet concurrently allow for axial sliding movement therebetween. A suitable clearance between the exterior surface of shaft 88 and the interior surface of the elongated tubular member 65 is about 3/32 inch.

The inside of the elongated lower portion 52 includes two or more equally angularly spaced apart interior grooves 53 (see FIG. 8) which extend in the longitudinal direction of the elongated lower portion 52, as well as circular openings 54 in the lower end 52*a* which communicate with the lowermost end of each groove, these openings serving a purpose which will be described below. Preferably three or more grooves and circular openings will be used.

The intermediate member 70 is in the form of an elongated hollow cylinder, this cylinder having a smaller outer diameter than the inner diameter of the elongated lower portion 52, for example, a difference in diameters of about 1/16 to 3/16 inch, and screwed into threaded holes located on the outside of the upper end 70*b* of the intermediate member 70 are a number of radially-extending button members 71 (the number of threaded holes and button members being equal to the number of grooves in the elongated lower portion 52) which have heads 72 that not only include a groove therein to allow screwing of the button members in and out of the threaded holes via the circular openings 54 in the lower end 52*a* of the lower portion 52, but which also are shaped and sized so as to slidingly fit within the corresponding grooves 53 on the inside of the elongated lower portion 52.

The inside of the intermediate member 70 includes two or more equally angularly spaced apart interior grooves 73 (see FIG. 9) which are similar to grooves 53 in lower portion 52, which grooves 73 extend in the longitudinal direction of member 70, as well as circular openings 74 (through the lower end 70*a*)similar to circular openings 54 in lower portion 52, each opening 74 communicating with the lowermost end of each groove 53. Preferably three or more grooves and circular openings will be used.

The lower member 80 is also in the form of an elongated hollow cylinder, this cylinder having a smaller outer diameter than the inner diameter of the intermediate member 70, for example, a difference in diameters of about 1/16 to 3/16 inch, and screwed into threaded holes located on the outside of the upper end 80*b* of the member 80 are a number of radially-extending button members 81 (similar to button members 71) with heads 82 which fit within the grooves 73 in the intermediate member 70. These button members 81 are screwed in and out of the threaded holes located on the outside of the upper end 80*b* via the circular openings 74 extending through the lower end 70*a* of the intermediate member 70. At the lower end 80*a* of the lower member 80 are positioned one or more drive rods 83 which extend through and across the lower end 80*a* and through suitable holes in the lower end rotatable shaft 88. These drive bars not only function to interconnect the shaft 88 with the lower member 80, but they also act as a screen similarly to protective bars 32 in FIG. 4.

Figure 5:
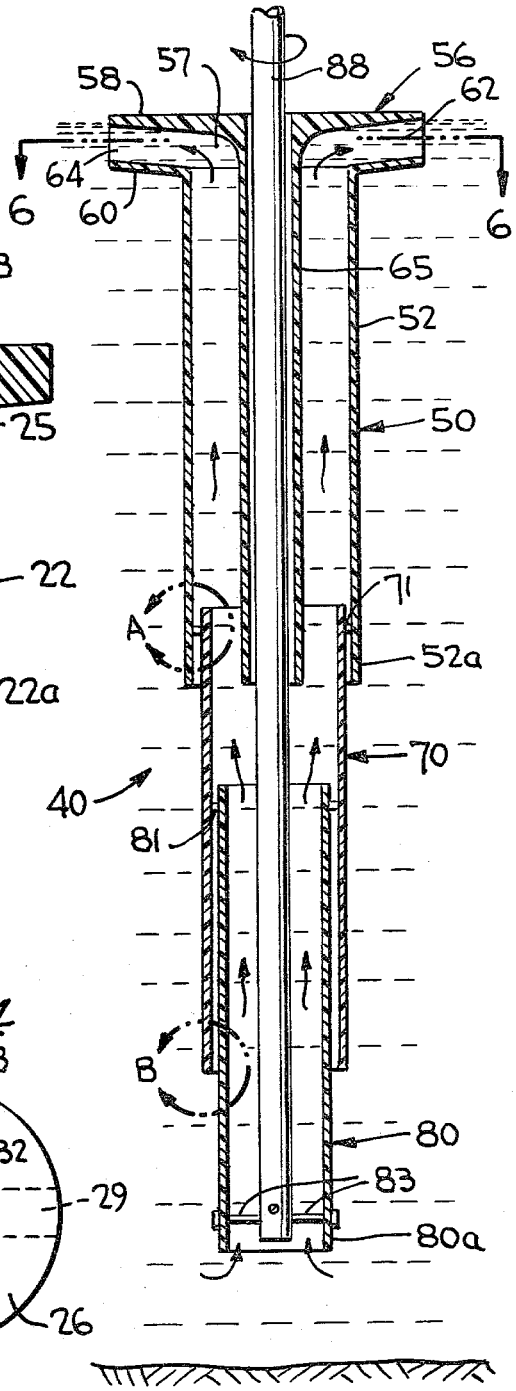
FIG. 5 shows a cross sectional view of another embodiment of ice-formation-preventing device constructed in accordance with the present invention, the lower portion of a drive shaft used to rotate the device also being shown.

A critical feature of the ice-formation-preventing device shown in FIG. 5 is the fact that the enlarged head portion 56 includes means for providing a buoyancy to the entire upper member 50. In this way the upper member 50, by its slidable relationship with rotatable shaft 88, can be automatically and continuously positioned such that the outlet ends of channels 61–64 will be at or near the surface of the water in which it is positioned regardless of the level of the water above the bottom of the water system (and regardless of the surface level of the water above the lower end of the stationarily positioned shaft 88). Thus, the enlarged head portion 56 will include between the channels 61–64 and between the outer periphery of cap member 58 and the surface 60 a buoyancy-creating means. Such means may be, for example, in the form of a cork or styrofoam packing 65 (see FIG. 6), or else in the form of molded hollow chambers 66 which contain either air or some lighter-than-air gas, e.g., such as helium.

The operation of this embodiment is as follows: assuming that the device 40 has been submerged in a body of water such that the lower end of rotatable shaft 88 locates the lower end 80*a* of lower member 80 at the desired depth (but in no event closer than about one foot from the bed at the bottom of the body of water), and assuming that the buoyancy of the upper member 50 has suitably placed it approximately at the surface of the water, the shaft 88 is rotated in one direction or another (in FIG. 5 the rotation is shown to be clockwise), and the rotation of shaft 88 will concurrently cause (via drive rods 83) the lower member 80 to rotate; the rotation of lower member 80 will cause (via the interengagement of the button members 81 extending radially outwardly of the upper end 80*b* of lower member 80 with the interior grooves 73 located in the intermediate member 70) the intermediate member 70 to rotate; and the rotation of intermediate member 70 will cause (via the interengagement of the button members 71 extending radially outwardly of the upper end 70*b* of the intermediate member 70 with the interior grooves 53 in the upper member 50) the upper member 50 to rotate. Water will then be centrifugally discharged through channels 61–64 and concurrently sucked up into the lower end 80*a* of the lower member 80 and through the interiors of all the elements (see arrows in FIG. 5), thereby creating a flow of warmer subsurface water to mix with the colder water at the surface.

At the same time as the foregoing, as the surface level of the water changes, and due to the slidable relationship between the heads of the various button members 81 and 71 attached to each member 80 and 70 and the grooves 73 and 53 in members 70 and 50, the positioning of upper member 50 will be allowed to change in a corresponding fashion due to telescopic movements between the various members. Since the elongated lower portion 52, the intermediate member 70 and the lower member 80 can have a length of up to about three feet, a total water surface level variation of about nine feet can be accomodated. It is obvious that, if desired, additional members similar to member 70 could be utilized to provide the device with additional depth extension possibilities, whereas if a lesser depth extension were desired, the intermediate member 70 could be eliminated.

None of the members 50, 70 or 80 can become disconnected from one another since the noted grooves 53 and 73 in the members 50 and 70 include abutment stops (see, for example, numerals 53*a* and 73*a* in FIGS. 8 and 9 which represent lower abutment stops) which effectively function as stop means for sliding movement of the various button members slidable therewithin. However, removal of button members 71 and 81 through openings 54 and 74, as well as removal of drive rods 83 from the lower end 80*a* of lower member 80, will allow the device to be removed from shaft 88 and completely disassembled.

A further embodiment of present invention is shown in FIGS. 10–12, this embodiment being similar in many respects to that shown in FIGS. 5–9. In this embodiment, however, both the elongated interior member 65*a* and the rotatable shaft 88*a*, instead of having a circular cross section, have a generally square cross section, such that rotation of the shaft 88*a* will directly cause rotation of the upper member 50*a*. Drive rods 83 utilized in the FIG. 5 embodiment are dispensed with. Instead, the tip end of the rotatable shaft 88*a* is provided with a flat abutment member such as a disk 90 which has a larger diameter than the diagonal dimension of the shaft. This flat abutment member 90 is cooperable with a retaining ring 95 (see FIG. 12) which is threadedly attached via four threaded bolts 96 to be positioned concentrically within the lower end 80*a'* of lower member 80*a*. The weight of the intermediate members 70*a* and 80*a* will keep these elements submerged while the buoyant upper member 50*a* is being rotated by shaft 88*a*; however, if the surface of the water drops down such that elements 50*a*, 60*a* and 70*a* will telescopically compress, lower member 80*a* will be prevented from falling off the end shaft 88*a* by the abutment of retaining ring 95 against the flat abutment member 90 attached to the tip end of the shaft 88*a*, and the intermediate member 70*a* and the upper member 50*a* will be similarly supported by abutment of the button members 81*a* and 71*a* against upper abutment stops in the grooves (not shown) located in the members 70*a* and 50*a*.

A still further embodiment of the invention, which embodiment in fact represents a simplification of the latter-mentioned one, involves an ice-formation-preventing device which will consist of only the last-mentioned buoyant upper member having an elongated interior member therein with a square cross section, such that rotation of the shaft (which has a corresponding yet smaller square cross section) will directly cause rotation of the buoyant upper member. The buoyant upper member will be slidable along the length of the shaft to accommodate water level variations, and can include a means at the lower end of the elongated lower portion thereof which is cooperable with abutment means connected to the lower end of the rotatable shaft to prevent the upper member from falling away from the stationary shaft when the water level falls to a significant degree.

Figure 13:
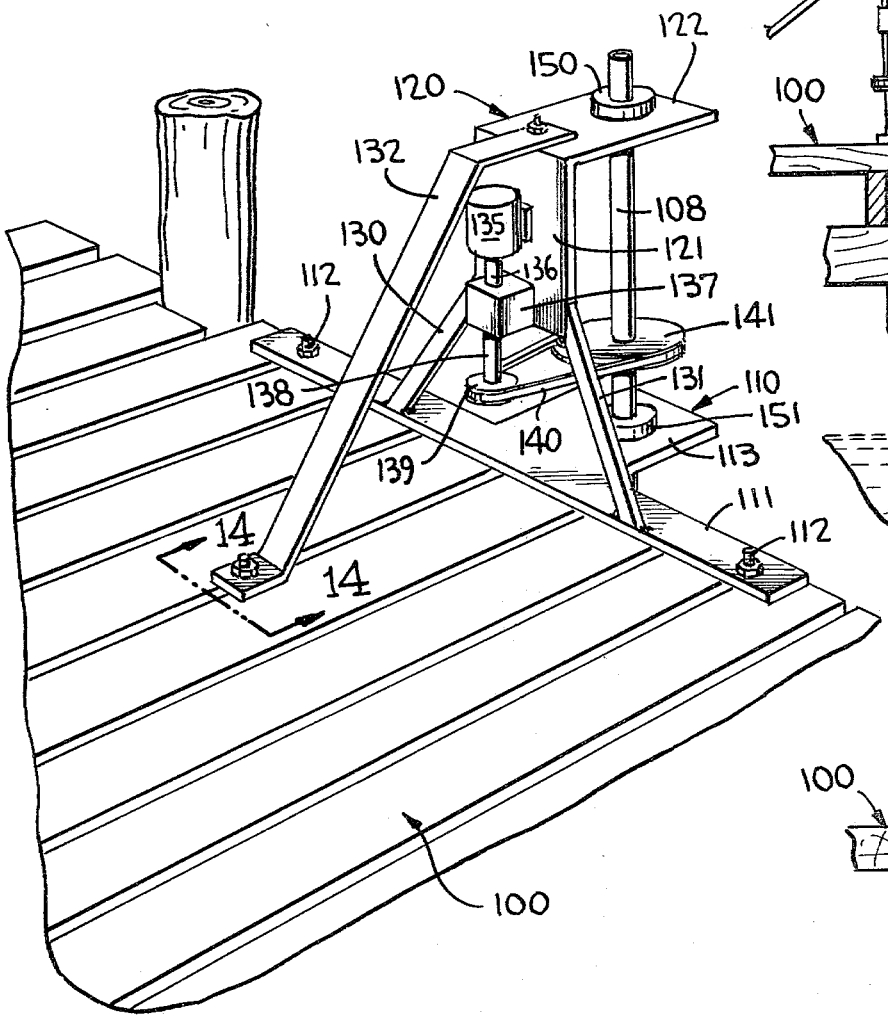
FIG. 13 shows a perspective view of an embodiment of driving mechanism for both supporting and driving a drive shaft used to rotate the ice-formation-preventing devices according to the present invention, the driving mechanism being shown mounted on a dock or pier.
Figure 14:
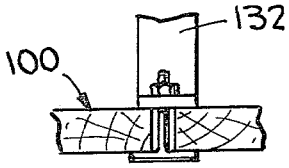
FIG. 14 shows a view of the mounting arrangement for one portion of the mechainism of FIG. 13 as seen along line 14—14.

FIG. 13 depicts an embodiment of driving mechanism which can be used to both support and rotate the upper end of the shaft, labeled 108, which rotates any of the embodiments of ice-formation-preventing device constructed in accordance with the present invention. The mechanism includes a horizontally oriented T-shaped bracket 110 that includes a cross element 111 that is attached to the floor 100 of a dock or pier by bolts 112, and an extension element 113 which extends beyond the edge of the floor 100 and in which is located an opening through which the shaft 108 extends. The mechanism also includes an upper L-shaped bracket 120 which has a vertically oriented segment 121 and a horizontally oriented segment 122, the segment 122 including an opening coaxial with the opening in the extension element 113 and through which the shaft 108 also extends. The L-shaped bracket is supported above the T-shaped bracket 110 by arms 130, 131 welded between segment 121 and cross element 111, as well as arm 132, one end of which is mounted on segment 122 and the other end of which is suitably bolted between planks forming the floor 100 (see FIG. 14). An electric motor 135 drives a friction wheel 139 via a first drive shaft 136, a gear mechanism 137 and a second drive shaft 138. A belt 140 connected between friction wheel 139 and friction wheel 141 attached to shaft 108 allows the ultimate rotation of shaft 108 by motor 135. Ball bearing mechanisms 150 and 151 connected to shaft 108 function to both retain shaft 108 in vertical position with respect to extension element 113 and segment 122, as well as to rotatably support shaft 108 in the holes in extension element 113 and segment 122.

Figure 15:
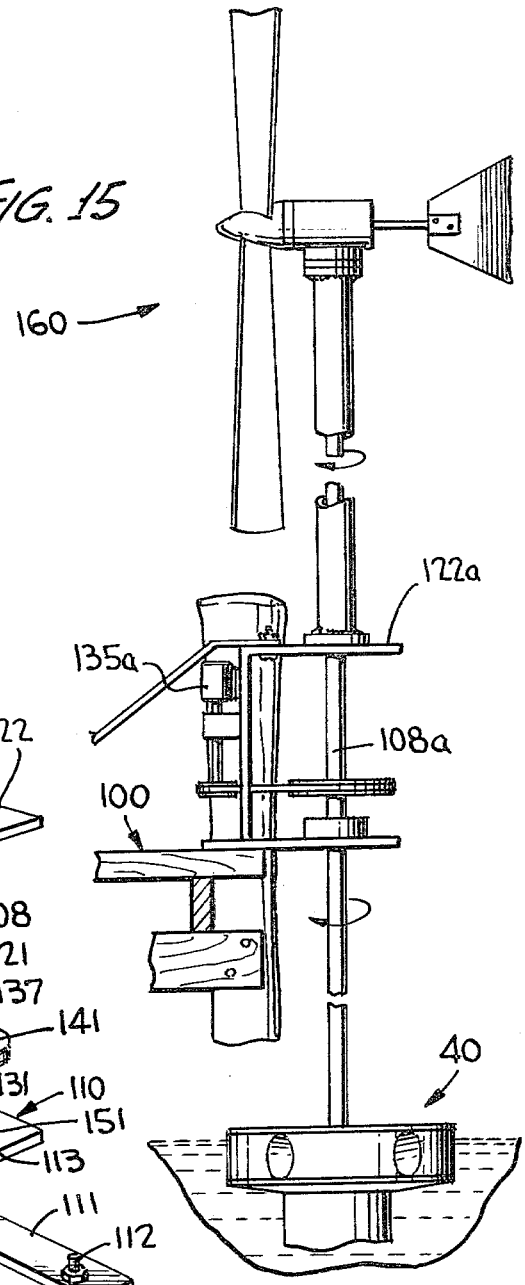
FIG. 15 schematically depicts a side view of another embodiment of driving mechanism mounted on a dock or pier, the view showing the driving mechanism interconnected with the top of an ice-formation-preventing device of the present invention.

The driving mechanism shown in FIG. 15 is similar to that shown in FIG. 13 except that a windmill 160 is mounted on segment 122*a* and mechanically interconnected with the upper end of shaft 108*a* to provide a rotation thereof when the wind is blowing. In this embodiment a sensing device (not shown) can be used to automatically activate motor 135*a* when no wind is blowing and shut off the motor when the windmill is functioning to rotate shaft 108*a*.

Although the foregoing description has provided details with respect to some preferred embodiments of the present invention, it will be obvious that many modifications and variations therein could be accomplished and yet still fall within the scope of the invention as defined in the following claims.

I claim:

1. A rotatable ice-formation-preventing device which is positionable just below the surface of a body of water exposed to cold air thereabove, said device comprising a cylindrical member having an elongated lower portion and an enlarged head portion, said elongated lower portion being hollowed out so as to have a tubular configuration with an internal flow passageway therein, and said enlarged head portion being partially hollowed out so as to have an internal flow area therein in communication with said internal flow passage; said enlarged head portion also including a generally disk-shaped cap member on the top side thereof so as to enclose said internal flow area, and at least two equally angularly spaced apart radially-extending channels in the outer peripheral portion thereof, said channels allowing for fluid communication between said interior flow area and the exterior of said enlarged head portion; said device when submerged just below the surface of a body of water and rotated by a shaft attached to the center of said cap member of said enlarged head portion, acting to centrifugally eject water from said interior flow area through said channels to externally of said enlarged head portion and concurrently sucking subsurface water upwardly through said interior flow passageway to said interior flow area so as to create a continuous flow of warmer subsurface water to mix with the colder water at the surface.

2. The device of claim 1 wherein said elongated lower portion and said enlarged head portion are made of plastic.

3. The device of claim 2 wherein each of said channels have a circular cross section with a uniform diameter throughout its length.

4. The device of claim 2 wherein each of said channels extends away from said interior flow area upwardly at an angle of between about 2° to 5° towards an imaginary plane formed by said generally disk-shaped cap member.

5. The device of claim 4 wherein said generally disk-shaped cap member includes a conically-shaped portion on the underside thereof which faces said interior flow area of said enlarged head portion.

6. A rotatable ice-formation-preventing device which is positionable just below the surface of a body of water exposed to cold air thereabove and which can continuously accommodate variations in the surface level of the water, said device comprising an upper member, an intermediate member and a lower member, said upper member including an elongated lower portion, an enlarged head portion, and an elongated interior member; said elongated lower portion being hollowed out so as to have a tubular configuration with an internal flow passageway therein as well as including slide connection means for axially slidable interconnection with said intermediate member; said enlarged head portion being partially hollowed out so as to have an internal flow area therein in communication with said internal flow passage, said enlarged head portion also including an annular cap member and at least two equally angularly spaced apart radially-extending channels in the outer peripheral portion thereof, said channels allowing for fluid communication between said interior flow area and the exterior of said enlarged head portion, and buoyancy-creating means; and said elongated interior member being connected to the inner rim of said annular cap member and extending centrally through said enlarged head portion and said elongated lower portion, said intermediate member being in the form of an elongated hollow cylinder which is axially and telescopically slidable with respect to said elongated lower portion of said upper member, said intermediate member including first slide connection means for interengagement with said slide connection means for interengagement with said slide connection means on said elongated lower portion to provide for axial sliding interconnection therebetween, as well as second slide connection means for interconnection with said lower member, and said lower member being in the form of an elongated hollow cylinder which is axially and telescopically slidable with respect to said intermediate member, said lower member including slide connection means for interengagement with said second slide connection means on said intermediate member to provide for axial sliding interconnection therebetween, said device when submerged below the surface of a body of water and rotated by a rotatable drive shaft extending downwardly through said elongated interior member of said upper member and centrally through said intermediate member and said lower member, acting to centrifugally eject water from said interior flow area of the enlarged head portion of the upper member and concurrently suck water upwardly through the interiors of said lower member, said intermediate member and said elongated lower portion of said upper member to thereby create a continuous flow of warm subsurface water to mix with the colder water at the water's surface, while the telescopic arrangements of said intermediate member with the elongated lower portion of said upper member and said lower member with said intermediate member allow the buoyancy-creating means in said enlarged head portion of said upper member to continuously retain said upper member at or near the water's surface regardless of variations therein.

7. The device of claim 6 wherein the lower end of said lower member includes bolt means for attaching said lower member to the lower end of the drive shaft located therewithin such that rotation of said drive shaft directly causes rotation of said lower member.

8. The device of claim 7 wherein said elongated interior member of said upper member has a circular cross section and wherein the drive shaft extending therethrough has a circular cross section of slightly smaller dimensions than the inner diameter of said elongated interior member.

9. The device of claim 6 wherein said elongated interior member of said upper member has a generally square cross section and wherein the drive shaft extending therethrough has a generally square cross section of slightly smaller dimensions than the inside of said interior member such that rotation of said drive shaft directly causes rotation of said upper member.

10. The device of claim 9 wherein the lower end of said lower member includes retention means cooperable with abutment means at the lower end of the drive shaft extending therewithin to prevent said lower member from falling off the end of the drive shaft.

11. The device of claim 6 wherein said upper member, said intermediate member and said lower member are made of plastic.

12. The device of claim 6 wherein each of said channels in said enlarged head portion of said upper member have a circular cross section with a uniform diameter throughout its length.

13. The device of claim 12 wherein each of said channels extends away from said interior flow area in said enlarged head portion upwardly at an angle of between about 2° to 5° towards an imaginary plane formed by said annular cap member.

14. The device of claim 6 wherein said buoyancy-creating means comprises cork or styrofoam.

15. The device of claim 6 wherein said buoyancy-creating means comprises chambers filled with air or a lighter-than-air gas.

16. The device of claim 6 wherein said intermediate member slidingly fits within said elongated lower portion of said upper member, and wherein said lower member slidingly fits within said intermediate member.

17. The device of claim 16 wherein said sliding connection means on said elongated lower portion of said upper member comprises at least two equally angularly spaced apart elongated grooves on the interior thereof, wherein said first slide connection means on said intermediate member comprises at least two equally angularly spaced apart and removable button members extending outwardly from the upper outer side thereof, said button members on said intermediate member slidingly engaged within said grooves in said elongated lower portion, wherein said second slide connection means on said intermediate member comprises at least two equally angularly spaced apart elongated grooves on the interior thereof, and wherein said slide connection means on said lower member comprises at least two equally angularly spaced apart and removable button member extending outwardly from the upper outer side thereof, said button member on said lower member slidingly engaged within said grooves in said intermediate member.

18. The device of claim 16 wherein each of said grooves includes opposed means forming abutment stops to arrest sliding movements of the button members therewithin.

19. The device of claim 18 wherein each of said elongated lower portion of said upper member, and said intermediate member include openings therethrough communicating with the grooves therewithin to allow removal of the button members from attachment to the outer sides of the intermediate member and the lower member, respectively.

20. A rotatable ice-formation-preventing device which is positionable just below the surface of a body of water exposed to cold air thereabove and which can continuously accommodate variations in the surface level of the water, said device comprising:

an upper member including an elongated lower portion, an enlarged head portion, and an elongated interior member; said elongated lower portion being hollowed out so as to have a tubular configuration with an internal flow passage therein; said enlarged head portion being partially hollowed out so as to have an internal flow area therein in communication with said internal flow passage, said enlarged head portion also including an annular cap member and at least two equally angularly spaced apart radially-extending channels in the outer peripheral portion thereof, said channels allowing for fluid communication between said interior flow area and the exterior of said enlarged head portion, and buoyancy-creating means; and said elongated interior member being connected to the inner rim of said annular cap member and extending centrally through said enlarged head portion and said elongated lower portion, said interior member having a generally square cross section;

said device when submerged below the surface of a body of water and rotated by a rotatable drive shaft having a generally square cross section of slightly smaller dimensions from the inside dimensions of said elongated interior member and axially slidingly extending through said elongated interior member acting to centrifugally eject water from said interior flow area of the enlarged head portion and concurrently suck water upwardly through the interior flow passage of the elongated lower portion to thereby create a continuous flow of warm subsurface water to mix with the colder water at the water's surface, and the device sliding along the rotatable drive shaft to accommodate water surface level variations.

21. The device of claim 20 wherein said elongated lower portion includes retention means cooperable with abutment means at the lower end of the drive shaft extending therewithin to prevent the device from falling off the end of the drive shaft.

* * * * *